US009739532B2

(12) United States Patent
Baugh et al.

(10) Patent No.: US 9,739,532 B2
(45) Date of Patent: Aug. 22, 2017

(54) BOTANICAL FREEZE DRYING SYSTEM AND METHOD

(71) Applicants: Steven F. Baugh, Broomfield, CO (US); Michael S. Turcotte, Denver, CO (US)

(72) Inventors: Steven F. Baugh, Broomfield, CO (US); Michael S. Turcotte, Denver, CO (US)

( * ) Notice: Subject to any disclaimer, the term of this patent is extended or adjusted under 35 U.S.C. 154(b) by 14 days.

(21) Appl. No.: 15/016,235

(22) Filed: Feb. 4, 2016

(65) Prior Publication Data

US 2016/0245588 A1 Aug. 25, 2016

Related U.S. Application Data

(60) Provisional application No. 62/112,051, filed on Feb. 4, 2015.

(51) Int. Cl.
*F26B 5/06* (2006.01)
*F26B 9/06* (2006.01)

(52) U.S. Cl.
CPC ..... *F26B 5/06* (2013.01); *F26B 9/06* (2013.01); *F26B 2200/20* (2013.01); *F26B 2200/22* (2013.01)

(58) Field of Classification Search
CPC ..... F26B 5/06; F26B 9/06; F26B 2200/20; F26B 2200/22
USPC ..... 34/92
See application file for complete search history.

(56) References Cited

U.S. PATENT DOCUMENTS 1,799,478 A * 4/1931 Peebles ..... B01D 1/16 159/17.2
2,744,391 A * 5/1956 Newenham ..... F25D 31/002 165/133
3,122,487 A * 2/1964 Mroz ..... B01D 53/00 159/17.4
3,362,835 A * 1/1968 Thuse ..... A23F 5/32 159/3
3,815,251 A * 6/1974 Van Gelder ..... F26B 5/06 34/289
4,856,203 A * 8/1989 Wennerstrum ..... F26B 5/048 34/259
5,822,882 A * 10/1998 Anger ..... F26B 5/06 34/296
6,610,250 B1 * 8/2003 Tuma ..... A61L 2/07 134/169 R
6,935,049 B2 * 8/2005 Alstat ..... F26B 5/06 34/288

(Continued)

FOREIGN PATENT DOCUMENTS

GB 1370683 A * 10/1974 ..... F26B 5/06
KR 100789215 B1 * 1/2008

*Primary Examiner* — Stephen M Gravini
(74) *Attorney, Agent, or Firm* — Skaar Ulbrich Macari, P.A.

(57) ABSTRACT

Systems and methods for freeze drying botanical or herb items or products using a modular vacuum chamber configuration are provided. Such configurations can reduce or prevent the evaporative loss of volatile compounds while reducing the temperature and removing air to prevent oxidation of the product. The freeze drying systems and methods of the present invention can improve organoleptic characteristics, shelf life, and extractions.

20 Claims, 5 Drawing Sheets

(56) References Cited

U.S. PATENT DOCUMENTS

| | | | | |
|---|---|---|---|---|
| 8,877,469 | B2 * | 11/2014 | Durance | C08J 9/28 219/694 |
| 8,919,007 | B2 * | 12/2014 | Friess | F26B 5/06 250/231.1 |
| 8,966,782 | B2 * | 3/2015 | Kuu | F26B 5/06 34/287 |
| 9,052,138 | B2 * | 6/2015 | DeMarco | F26B 5/065 |
| 9,347,707 | B2 * | 5/2016 | Struschka | F26B 5/06 |
| 2012/0030963 | A1 * | 2/2012 | Durance | C12M 47/14 34/284 |
| 2013/0199734 | A1 * | 8/2013 | Schultz-Fademrecht | G01N 33/6803 159/47.1 |
| 2014/0230266 | A1 * | 8/2014 | Luy | F26B 5/06 34/284 |
| 2016/0245588 | A1 * | 8/2016 | Baugh | F26B 5/06 |

* cited by examiner

BOTANICAL FREEZE DRYING SYSTEM AND METHOD

PRIORITY

This Application claims priority to and the benefit of U.S. Provisional Patent Application No. 62/112,051, filed Feb. 4, 2015, which is hereby fully incorporated herein by reference.

FIELD OF THE INVENTION

The present invention relates generally to botanical item processing and, more specifically, to systems, devices, and methods for freeze drying botanical or herb items.

BACKGROUND OF THE INVENTION

Currently, botanical or herb agricultural products are dried and cured in a conventional manner, with temperature and humidity control, over a period of weeks, months, or even years for some teas. This process is prone to product loss and loss of product value through mold, mildew, loss of terpenes (essential oils), and browning of the flower and darkening of the extract, among other price point indicators. Additionally water interferes with supercritical $CO_2$ extractions as it is a common modifier in these extractions and introduces a process variable. For these reasons the botanical products are often thoroughly dried, causing additional loss of volatile essential oils and darkening of the extract due to oxidation of compounds.

Large investments are required to properly equip and operate a conventional dry room. High air flow requirements, and associated HVAC costs, are important to prevent mold and mildew. And while the ventilation removes ethylene and its byproducts, the loss of volatile compounds is accelerated. Traditionally, significant space must be dedicated to a conventional drying process—often taking 3 weeks or more, with the risk of product degradation being a natural outcome.

Freeze drying can be accomplished in hours, while preserving the essential oil profile of the plant and limiting oxidation. Alcohol extractions can pull water, thereby changing the solubility of the system and discriminating against lipid soluble compounds like essential oils. Furthermore, water sensitive extractions like supercritical $CO_2$ and alcohol will be able to use thoroughly dried material that has retained more of the organoleptic and quality characteristics customer's desire.

Freeze drying of botanicals can reduce the time and risk involved in traditional drying methods, preserve organoleptic indicators, and remove variable water content that may interfere with extractor operation (supercritical $CO_2$ in particular). For these reasons multiple moisture endpoints are desirable with botanicals depending on the end use, where traditional freeze drying targets the 1% to 3% moisture required for extended shelf life of foodstuffs.

However, in the drying of botanicals, curing is also commonly combined into one process. Freeze drying only addresses the drying of the botanicals, and not the chemical and biological changes taking place during curing. Historically, botanicals have been dried initially, then cured or cured as part of the drying process. In some cases it can be advantageous to dry the botanicals to a higher moisture content rapidly with the freeze drier, and then finish at different conditions under various gases to optimize the curing process while removing the risk and time from the preliminary drying step.

As such, there is a need for a new and improved system and method of addressing these deficiencies and problems presented with conventional drying and curing of botanicals.

SUMMARY OF THE INVENTION

The present application provides specific advantages, such as a modular system, to freeze drying botanicals. A freeze drier conceptually is any combination of a chamber below the freezing point of water under vacuum to effect the sublimation of water. Such a design is also proven to reduce or prevent the evaporative loss of volatile compounds while reducing the temperature and removing air to help prevent oxidation of the product. The vacuum promotes the sublimation of water and prevents the contamination of product that could occur in a simple freezer without vacuum. Traditionally freeze drying has come to mean the application of vacuum to frozen materials containing water to achieve improvements in shelf life. Providing the unique freeze drying systems and methods of the present invention can improve organoleptic characteristics, shelf life, and extractions.

The modular system can include a plurality of vacuum chambers, a plurality of conduits, a condenser unit, and a vacuum pump. The various components and devices can be in operable communication to provide the flexible and modular system to provide tailored and optimized freeze drying spaces. Due to the modular nature of the vacuum chambers and control system, each batch (or even plant) can be singularly optimized for the various processes during manufacturing without impacting the other batches. The system can be housed or provided within a large walk-in room or structure, or at least partially contained (e.g., the vacuum chambers) within a smaller chest, such as the size and shape of a residential or commercial freezer unit.

Figure 1:
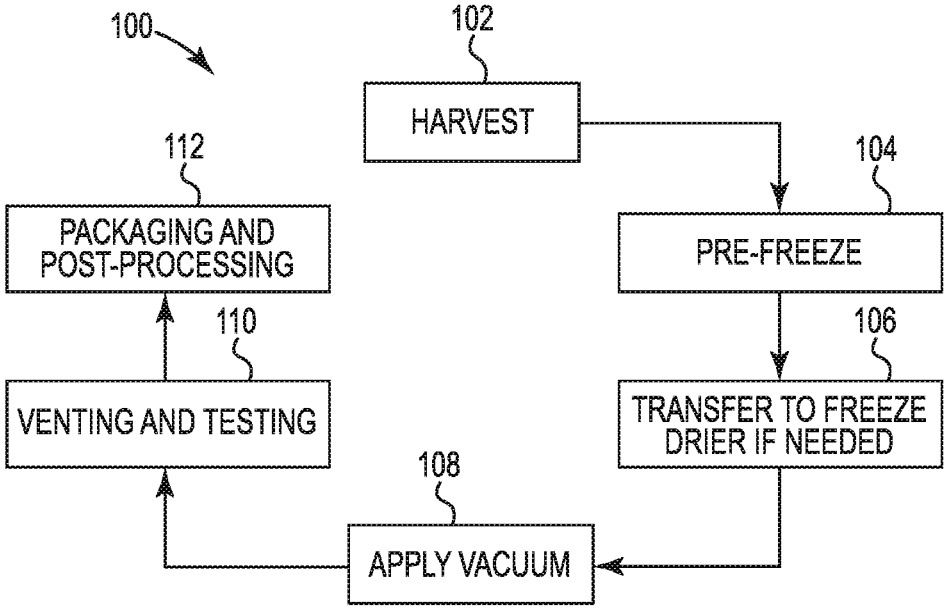
FIG. 1 is a flow chart summarizing the freeze drying process, in accordance with embodiments of the present invention.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the spirit and scope of the invention as defined by the appended claims. For illustrative purposes, cross-hatching, dashing or shading in the figures is provided to demonstrate sealed portions and/or integrated regions or devices for the package.

DETAILED DESCRIPTION OF EXAMPLE EMBODIMENTS

In the following descriptions, the present invention will be explained with reference to example embodiments thereof. However, these embodiments are not intended to limit the present invention to any specific example, embodiment, environment, applications or particular implementations described in these embodiments. Therefore, description of these embodiments is only for purpose of illustration rather than to limit the present invention. It should be appreciated that, in the following embodiments and the attached drawings, elements unrelated to the present invention are omitted from depiction; and dimensional relationships among individual elements in the attached drawings are illustrated only for ease of understanding, but not to limit the actual scale.

Referring generally to FIGS. 1-8, the devices, components, and methods for a botanical or herb freeze drying system 100 in accordance with the present invention are provided. Embodiments can be employed to modularly freeze dry various botanical items such as, but not limited to, cannabis, tobacco, and a myriad of other herbs or like items/products.

Referring to the process of embodiments of the system 100 in FIG. 1, drying and curing processes are often combined, removing the moisture and aging the products. With freeze drying the process can happen too quickly to age the products, so the products can be aged on the plant before harvest. This is not necessary, but can be preferred for some applications.

Pre-freezing can be desirable because a vacuum does not transfer heat efficiently to bring the plant material down to frozen throughout. Pre-freezing is similar to the step in live extracts where the plant is frozen prior to extraction, but not in a vacuum. Ice crystals will form on the surface of the plant and the surface of the container, but this superficial moisture is merely migrating to the surface. A significant vacuum (<5 torr) is required to promote sublimation for true freeze drying.

Temperature and vacuum are critical parameters to control—ultimately influencing the final moisture content, the other essential oils retained, and the time it takes to process. In addition to the temperature of the vacuum chamber and material being processed, the temperature of the ice trap/condenser also creates a driving force for drying due to the temperature gradient between the chamber/material and the ice trap/condenser.

FIG. 1 shows an exemplary embodiment of the system 100 and processing via the present invention. Step 102 can include the "harvest" stage. This includes aging the plant, which can be critical because aging and curing will not take place during freeze drying. Typically, this is done as part of the drying process, if at all. Often times the product is just dried with no aging. However, aging on the plant can be preferred with certain applications.

Step 104 can include "pre-freezing." This is the processing of the botanical material prior to the application of vacuum within the system 100. This allows rapid cooling and freezing of the botanical product, where a vacuum does not conduct heat and would release volatile compounds at temperatures above freezing if the warm material was placed directly into the freeze drier and vacuum applied immediately.

Next, Step 106 can include the "transfer of material or application of vacuum" stage. If the cooled vessel used for the freeze drying is used for pre-freezing then the vacuum can simply be applied when the desired temperature has been achieved. Otherwise, the material can be transferred from the pre-freezing container to the pre-chilled freeze drier. As such, embodiments of the present invention can include pre-freezing the material before inserting it into the vacuum chambers, or the system 100 itself can apply temperatures to the provided material to freeze the material during operation of the system 100.

Step 108 can include "application of vacuum." Many different combinations of temperature and vacuum can be used on botanical agricultural products, depending on the end use and downstream process specifications. A condenser may or may not be required as part of the vacuum assembly given the rapid drying and higher moisture content target of some botanical products.

At Step 110 the process of "venting the freeze drier" can occur. Once the material has reached the desired moisture level (which can be monitored several ways, directly and indirectly) the vacuum must be vented so the freeze drier can be opened or disassembled. A filter and moisture trapping material (desiccant) can be placed in the vent line so the air pulled into the freeze drier during venting is clean and moisture-free, and not inadvertently adding moisture back to the product.

Further, "testing and analysis" can occur at this stage of the process. A quick moisture check can be accomplished in minutes using a variety of techniques. This step can be combined with the venting procedure, or performed in real-time with internal sensing mechanisms and devices.

Step 112 can include the "packaging or post-processing" stage of the process. Following confirmation of the desired moisture content, the product can be packaged for sale or used in a variety of downstream processes including a feed material for extractions.

In addition, "curing" can be performed. Post-drying processing can include curing, while other products will be packaged for sale directly, or not require curing (like extraction). However, others, such as tea, can include curing to reproduce the sensory attributes some customers desire. Freeze drying can be a first step, prior to curing, or an integral part of a continuous process (or anywhere in between).

Figure 2:
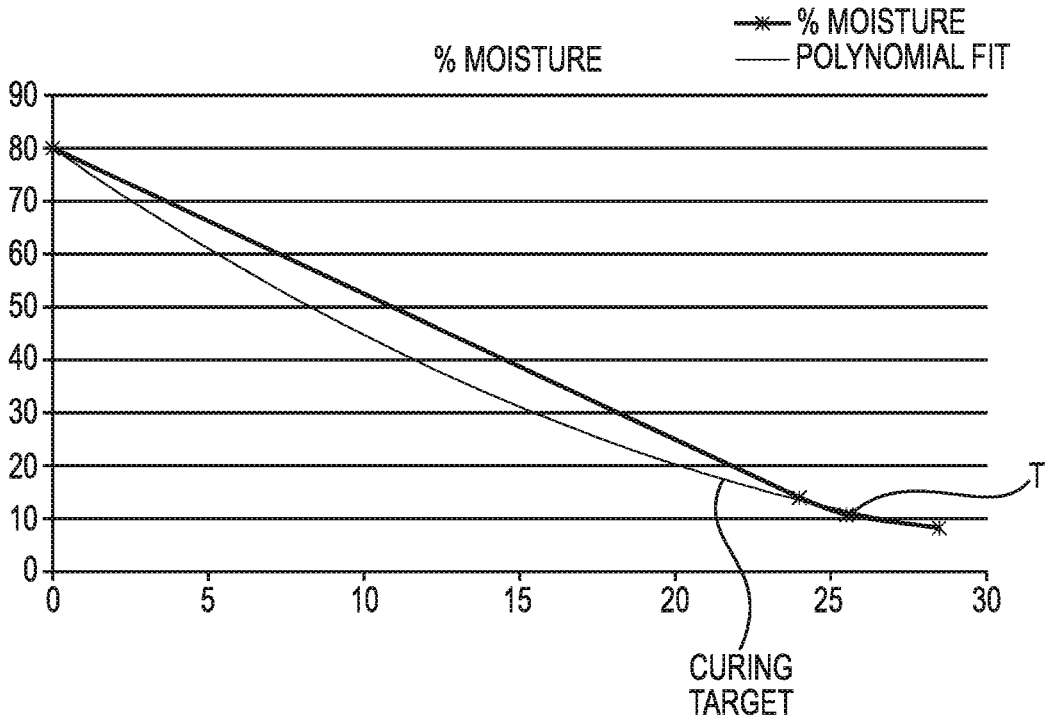
FIG. 2 shows botanical sample data at −5 degrees Celsius and 1 Torr, in accordance with embodiments of the present invention.
Figure 3:
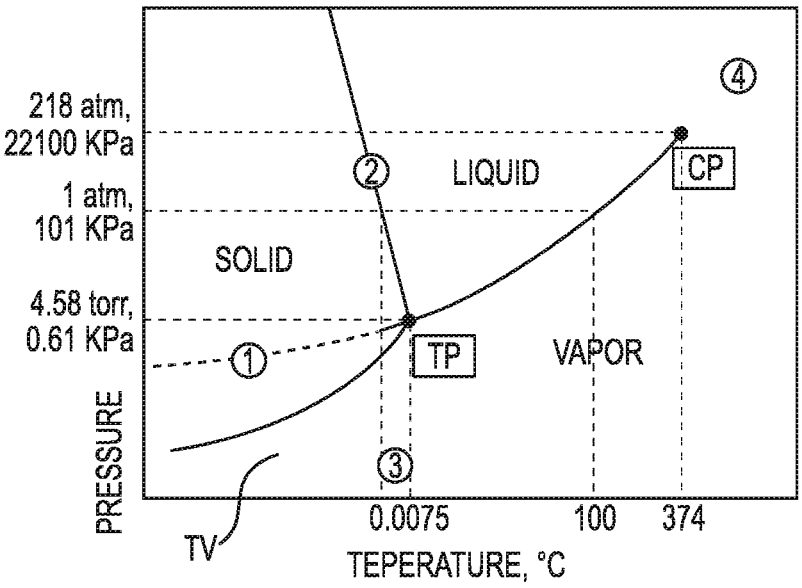
FIG. 3 shows a phase diagram for water, in accordance with embodiments of the present invention.

Turning to FIGS. 2-3, a phase diagram of water (FIG. 3) shows a deep vacuum (<5 torr) is necessary for sublimation of water. Water will sublime at atmospheric pressure, only very slowly, and freeze drying is classically described as vacuum-assisted sublimation of water. Running at the highest pressure that the system facilitates will increase the mass transfer of water to the condenser due to the temperature gradient between the material and the condenser, while an absolute vacuum would be an insulator between the material and condenser. For these reasons all variables must be controlled and optimized for each plant type and varietal (e.g., tall and thin, short and bushy), while maintaining regulatory traceability despite the fact that there are different conditions present for foods and botanical products.

A balance between temperatures, vacuum, and time must be optimized for each product and process. Almost complete removal of water might be necessary for a supercritical $CO_2$ extractor sensitive to water, while material product like potpourri might be dried slower, with a higher water content and more powerful aroma. These goals can all be achieved by proper control of variables, including the proper moisture content for long-term storage, as provided for with the present invention.

Variables such as time, temperature, and vacuum can be determined for each product, and in addition automated controls based on moisture data feedback (e.g., mass loss, infra-red sensor correlation, etc.) can monitor multiple samples to the same final moisture content. All combinations are possible with proper data logging and logic controllers. FIG. 2 shows the moisture content over time for a temperature of −5 degrees Celsius and a vacuum of approximately 1 torr.

Another unique problem related to the botanical and food industries relates to the tracking of individual plants and foods from farm to table. Small individual vacuum chambers are preferred versus one large chamber for many reasons, including batch size, container strength limitations, harvest timing, and process duration while providing flexibility for multiple moisture endpoints within each harvest.

The botanical freeze drying system 100 is also unique and advantageous in that it facilitates flexibility of harvest (batch) size, and frequency and drying differences between phenotypes while maintaining regulatory traceability per plant. The novel freeze drying method and equipment of the system 100 address the specific needs of the botanical industry that are currently unavailable with conventional systems and methods.

FIG. 2 shows the moisture content over time for a temperature of −5 degrees Celsius and a vacuum of approximately 1 torr. Several data points were collected, and the slope of water loss versus time will not be linear. Instead, it will be greater while the sample has more moisture on the surface, and slower as the remaining water must migrate through the plant material as approximated by the polynomial curve fit. Stems and other woody parts of the plant will hold moisture the longest, eventually wicking out into the already dry outer mass. Woody parts can be left and accounted for in the process, or removed to simplify and speed the process when the plant material will be extracted. Area T indicates the target moisture content for smoking/vaporizing. As depicted, the drying rate tapers off (e.g., slope) at the end.

FIG. 3 demonstrates the low vacuum (<5 Torr) necessary for rapid sublimation of water near the freezing point (0 degrees Celsius). While sublimation will occur at standard atmospheric pressure, only the surface water will be lost in a reasonable amount of time. For a manufacturing process the boundary between the solid and vapor phase must be approached or crossed for rapid freeze drying. Area TV indicates the target area—the transition from solid to vapor using vacuum.

Referring generally to FIGS. 4-8, several exemplary configurations are depicted to illustrate the unique and novel modular configuration of the system 100. Such systems and methods will benefit the botanical/herb industry—versus the traditional bulk freeze drier for the flood recovery and shelf-life industries. In the modular, flexible, configuration taught herein, each batch (or even plant) can be optimized for the various processes during manufacturing without impacting the other batches—versus the large single vessel freeze drier of conventional applications common when low moisture levels require hard drying to achieve long-term shelf-life gains, flood recovery of books, and the like.

Figure 4:
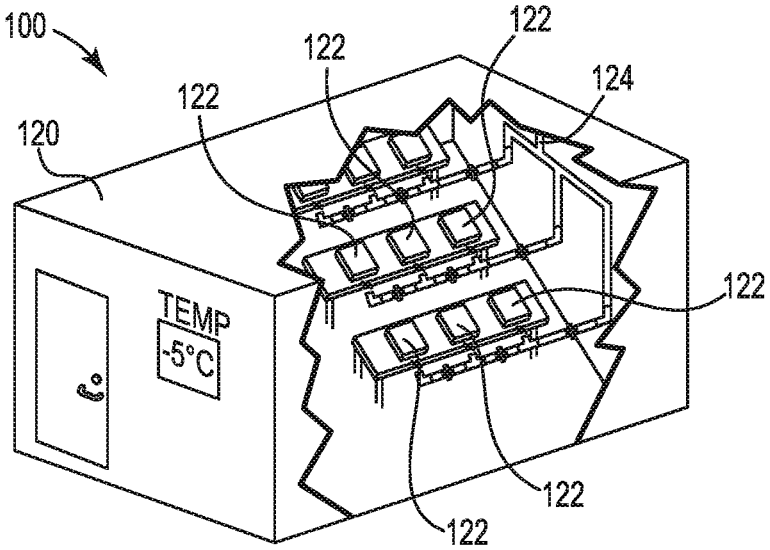
FIG. 4 shows a large walk-in freeze drier overview, including modular chamber configurations, in accordance with embodiments of the present invention.

FIG. 4 depicts the overview of a walk-in freezer or room 120 configuration for the system 100 including a plurality of modular vacuum chambers 122, each having corresponding lids 123. The containers, tubing, ducting and fittings can be made of materials commonly used in the vacuum or pressure control industries. A system of valves to isolate the various compartments, and banks of compartments, can be included as well. Multiple systems of shelves, tables or racks can be used within the same freeze drier. A centralized vacuum manifold 124 or system can be included. The larger walk-in freezer 120 can be temperature controlled.

Figure 5:
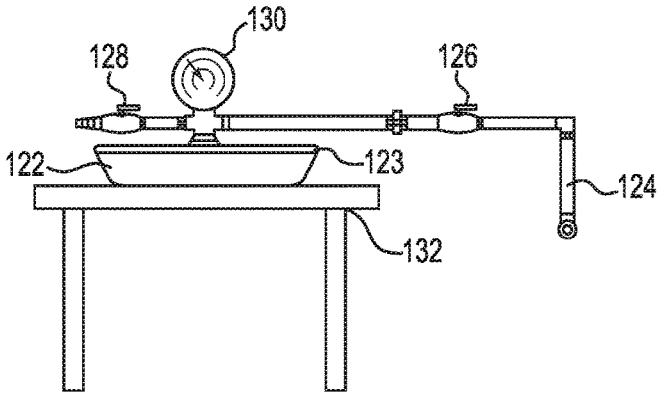
FIG. 5 shows a close-up view of the modular chamber configurations, including possible individual vacuum chamber and connections, in accordance with embodiments of the present invention.

FIG. 5 shows a close-up of a representative, modular, vacuum chamber 122, where multiple containers can be connected either individually or in a bank in operable communication to the vacuum manifold or duct 124, with an isolation valve 126 and vent 128 provided with each compartment or bank. In addition, one or more pressure gauges 130 can be included. One or more of these attachments or components of the modular chambers 122 can be operatively connected to the respective lids 123. In addition, the chambers 122 can be provided with or disposed on a table or rack 132. Further, the internal compartment or area of the chamber 122 can be compartmentalized or correspondingly divided to retain and/or isolate botanicals, or a plurality of botanicals.

Figure 5A:
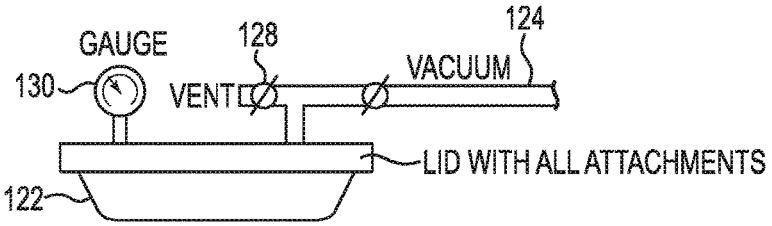
FIGS. 5*a*-5*c* show exemplary chamber configurations, in accordance with embodiments of the present invention.
Figure 5B:
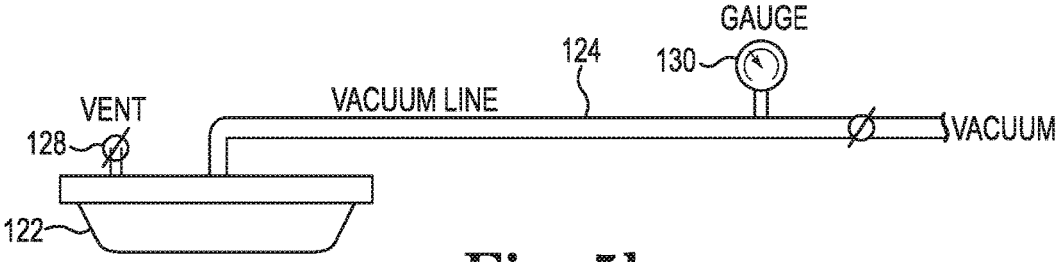
Figure 5C:
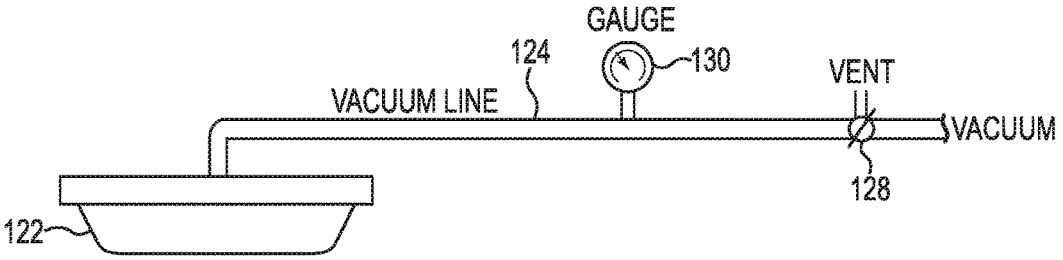

FIGS. 5*a*-5*c* depict various chamber 122 environments and constructs in accordance with embodiments of the present invention. Namely, various configurations for the valves, gauges, vents, and vacuum lines are depicted, and detailed herein. Other configurations consistent with the objectives and features disclosed herein are also envisioned for use, and can be included without deviating from the spirit or scope of the present invention.

Figure 6:
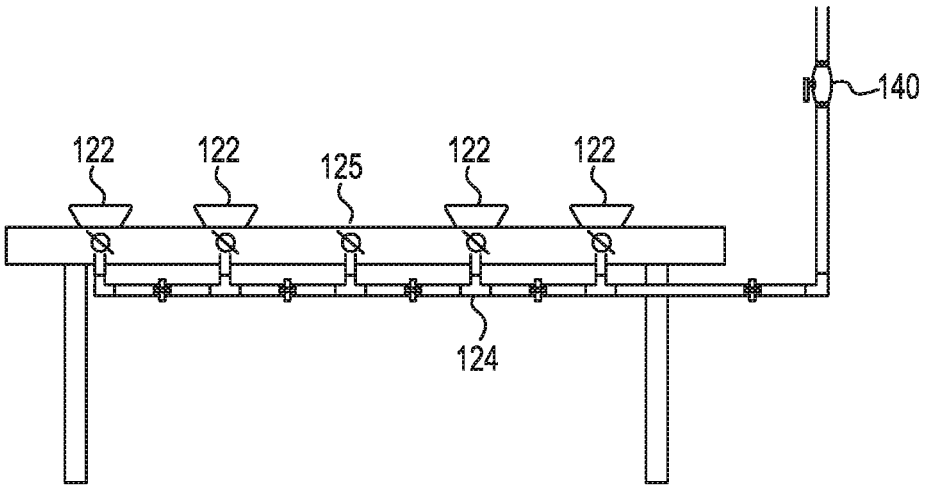
FIG. 6 shows connected modular vacuum chambers, each isolated and vented, in accordance with embodiments of the present invention.

FIG. 6 shows one way to connect the individual chambers 122, while still allowing each to be isolated and vented for maximum flexibility and isolated control. While a single chamber 122 is shown as excluded at 125 from the configuration, other iterations of modularity (e.g., chamber removal or inclusion) can be employed as well. A central manifold isolation valve 140 can be included and attached to the vacuum line 124 for the modular chambers 122.

Figure 7:
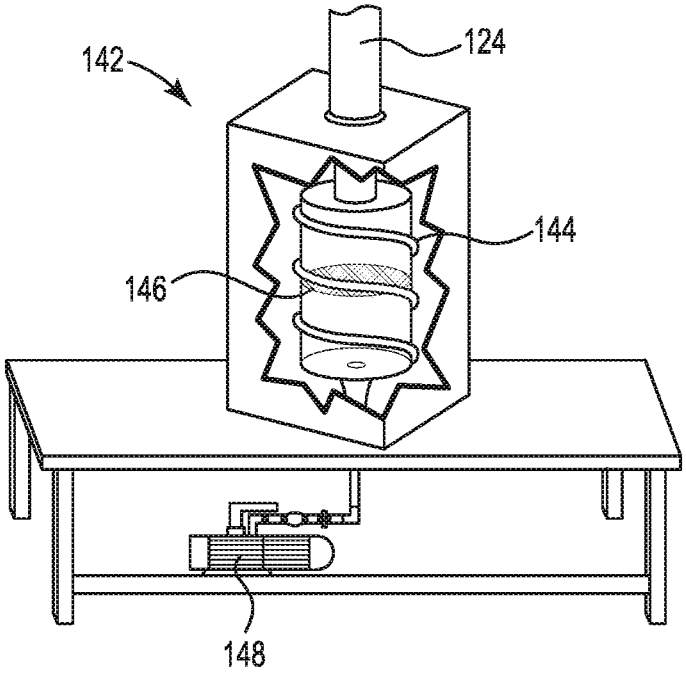
FIG. 7 shows an ice condenser coil and removable trap, in accordance with embodiments of the present invention.

FIG. 7 shows an embodiment of a condenser 142 design, where the condenser coils 144 are wrapped around a removable ice/vapor trap 146. Another configuration would provide the coils 144 inside a trap container. A vacuum manifold or trunk 124 feeds into the condenser 142, which includes an operatively connected vacuum pump 148 (e.g., capable of less than 1 Torr or 100 microns). All condenser/trap design configurations available to those of ordinary skill in the art could be used with the present invention.

Figure 8:
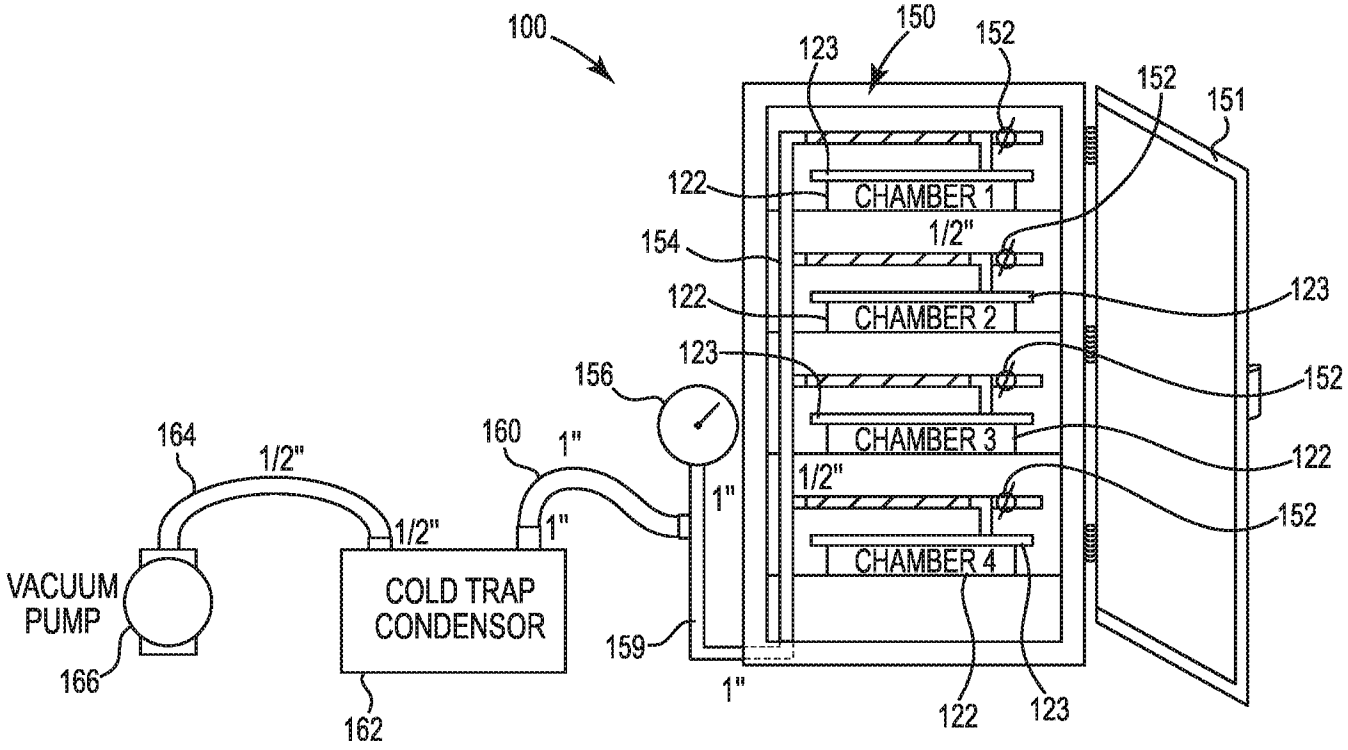
FIG. 8 shows a freeze chest and modular vacuum chamber configuration, in accordance with embodiments of the present invention.

Referring to FIG. 8, a freezer chest or system 150 embodiment of the present invention is provided. The size of the freezer structure 150 can vary greatly depending on the particular application needs—from the size of a small or regular sized residential freezer to a much larger walk-in construct. Like the configuration of the system 100 of FIG. 4, the chest 150 can include a closure portion or door 151, and a plurality of modular vacuum chambers 122, each having corresponding lids 123 or like connection features. Various fittings and connections can be employed (e.g., for medium or high vacuum). Further, each of the chambers 122 can include a three-way or like valve device 152 in operable communication with the respective chamber 122 and a cold trap condenser 162 via one or more tubing or conduit members 154. Each valve 152 allows the respective chamber 122 to be evacuated and vented separately to facilitate increased control and flexibility for the chamber modules of the system 100. A vacuum gauge 156 (e.g., high vacuum gauge) can be included in the system 100 intermediate the freezer 150 and the cold trap 162 to monitor the vacuum parameters—e.g., ensure the vacuum is below 5 torr. A vacuum pump 166 is included and in operable communication with the system 100 and the cold trap condenser 162.

The component fittings and tubing (rigid or flexible) of the system 100 can be common among embodiments (including at least the embodiments of FIGS. 4 and 8) of the present invention. For instance, various stainless steel and Teflon™ materials can be employed. ½ inch tubing, elbows, Ts, and stainless braid over Teflon™ hoses and adapters/fittings can be included within the chest 150—going to and from the chambers 122. Other options for the configuration can include stainless bellows hoses. Various 1 inch stainless tubing or like conduits (e.g., conduits 159, 160) can be included with the cold trap to prevent ice buildup or packing within the conduit lines. The conduits 164 in communication between the trap 162 to the pump 166 can include ½ inch tubing or hoses because ice formation will not be an issue in that area of the system 100 during operation. In addition, an oil mist filter can be included with the pump 166 exhaust to contain oil vapors released from the pump 166 during use.

In operation, the user can inspect the system 100 to ensure the temperature is stabilized at −5 degrees Celsius, and that all vent valves 152 are closed. Next, it may be necessary to inspect the condenser 162 to ensure it is empty. Using trays or other means, the user will add the botanical or like material to the vacuum chambers 122. The vacuum pump 166 can be started at this point. The lids 123 or like features of the vacuum chambers 122 can be placed on the chambers 122 to ensure a sealed fit. Next, one or more of the valves 152 can be closed to begin the vacuum process. In certain embodiments, monitoring of the vacuum drop will be necessary to ensure it drops to or below 1 torr on the large gauge 156. Upon completion of the freeze drying process, the vacuum pump 166 can be turned off and the vent valve on the condenser 162 can be opened. This will condense water from the air in the condenser 162, rather than the material in the vacuum chambers 122. The access door 151 or a like structure can be opened to provide access and to allow the dried contents to come to room temperature. This allows the system 100 to defrost between each run or process. Each of the valves 152 associated with the plurality of vacuum chambers 122 can be opened to ensure venting. A moisture analyzer can be used to test samples of the material contents. 12% to 14% can be ideal for packaging flower, while lower levels of moisture are desirable prior to extractions. This and other steps can be employed to produce additional runs of freeze drying of material contents within the system 100.

The present invention may be embodied in other specific forms without departing from the spirit or essential attributes thereof, and it is, therefore, desired that the present embodiment be considered in all respects as illustrative and not restrictive. Similarly, the above-described methods and techniques for forming the present invention are illustrative processes and are not intended to limit the methods of manufacturing/forming the present invention to those specifically defined herein. A myriad of various unspecified steps and procedures can be performed to create or form the inventive methods, systems and devices.

What is claimed is:

1. A modular system for freeze drying botanical items, comprising:
- a plurality of vacuum chambers each including a lid structure;
- at least one conduit in operable communication with the plurality of vacuum chambers;
- a plurality of valve devices in operable communication with the respective plurality of vacuum chambers;
- a condenser device in operable communication with the at least one conduit and the plurality of vacuum chambers; and
- a vacuum pump in operable communication with the condenser device.

2. The system of claim 1, further including a vacuum gauge in operable communication with the plurality of vacuum chambers.

3. The system of claim 1, wherein at least one of the plurality of valve devices is a three-way valve device.

4. The system of claim 1, further including a housing structure.

5. The system of claim 4, wherein the housing structure houses the plurality of vacuum chambers.

6. The system of claim 4, wherein the housing structure is a walk-in structure.

7. The system of claim 1, wherein the at least one conduit includes a plurality of conduits.

8. The system of claim 1, further including a door structure to selectively seal and isolate the plurality of vacuum chambers from at least the condenser device and the vacuum pump.

9. The system of claim 1, further including a centralized vacuum manifold in operable communication with the plurality of vacuum chambers.

10. A modular system for freeze drying botanical items, comprising:
- a housing structure including;
  - three or more vacuum chambers;
  - at least one conduit in operable communication with the three or more vacuum chambers;
  - three or more valve devices in operable communication with the respective three or more vacuum chambers;
- a condenser device provided outside the housing structure and in operable communication with the at least one conduit and the three or more vacuum chambers; and
- a vacuum pump provided outside the housing structure and in operable communication with the condenser device.

11. The system of claim 10, further including a vacuum gauge in operable communication with the three or more vacuum chambers.

12. The system of claim 10, wherein at least one of the three or more valve devices is a three-way valve device.

13. The system of claim 10, wherein the at least one conduit includes a plurality of conduits.

14. The system of claim 10, further including a door structure to selectively seal and isolate the three or more vacuum chambers from at least the condenser device and the vacuum pump.

15. A modular system for freeze drying botanical items, comprising:
- a walk-in housing structure including;
  - a plurality of vacuum chambers;
  - at least one conduit in operable communication with the plurality of vacuum chambers;
  - a plurality of valve devices in operable communication with the respective plurality of vacuum chambers;

a condenser device provided in operable communication with the at least one conduit and the plurality of vacuum chambers; and a vacuum pump provided in operable communication with the condenser device.

16. The system of claim 15, further including a vacuum gauge in operable communication with the plurality of vacuum chambers.

17. The system of claim 15, wherein at least one of the plurality of valve devices is a three-way valve device.

18. The system of claim 15, wherein the at least one conduit includes a plurality of conduits.

19. The system of claim 15, further including one or more table banks to house one or more of the plurality of vacuum chambers.

20. The system of claim 15, wherein the at least one conduit includes centralized vacuum manifold.

* * * * *